US011014583B2

(12) United States Patent
Reitz

(10) Patent No.: US 11,014,583 B2
(45) Date of Patent: May 25, 2021

(54) HOPPER CAR DISCHARGE GATES

(71) Applicant: Trinity Rail Group, LLC, Dallas, TX (US)

(72) Inventor: Lee A. Reitz, Euless, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 481 days.

(21) Appl. No.: 15/980,950

(22) Filed: May 16, 2018

(65) Prior Publication Data

US 2018/0345998 A1 Dec. 6, 2018

Related U.S. Application Data

(60) Provisional application No. 62/514,486, filed on Jun. 2, 2017.

(51) Int. Cl.
*B61D 7/02* (2006.01)
*B61D 7/20* (2006.01)

(52) U.S. Cl.
CPC *B61D 7/02* (2013.01); *B61D 7/20* (2013.01)

(58) Field of Classification Search
CPC ... B61D 7/02; B61D 7/20; B61D 7/26; B61D 7/28; B61D 7/32
See application file for complete search history.

(56) References Cited

U.S. PATENT DOCUMENTS 3,138,117 A * 6/1964 Dorey ..... B60P 1/56 105/282.3
4,455,110 A * 6/1984 Schipper ..... B61D 7/20 406/119
7,752,979 B2 7/2010 Early
7,814,842 B2 10/2010 Early
7,819,067 B2 10/2010 Early
(Continued)

FOREIGN PATENT DOCUMENTS

DE 424264 C 1/1926
EP 0419423 A1 3/1991

OTHER PUBLICATIONS

International Search Report and Written Opinion for PCT Patent Application No. PCT/US2018/034186, dated Aug. 21, 2018; 11 pages.

(Continued)

*Primary Examiner* — Jason C Smith
(74) *Attorney, Agent, or Firm* — Baker Botts, LLP

(57) ABSTRACT

According to some embodiments, a railcar comprises: an underframe comprising a center sill extending longitudinally along a centerline of the railcar; a hopper coupled to the underframe and comprising a discharge opening; and a discharge assembly coupled to the hopper. The discharge assembly comprises: a sloped side sheet, and a discharge gate frame in a plane offset from horizontal and extending from a bottom of the sloped side sheet to proximate the center sill. The discharge gate frame at least partially surrounds the discharge opening. The discharge assembly further comprises a discharge gate coupled to the discharge gate frame. The discharge gate is operable to move from a closed position that restricts a lading from discharging to an open position that permits the lading to discharge. Moving from the closed position to the open position comprises moving at an angle upward and transverse to the railcar.

15 Claims, 7 Drawing Sheets

(56) References Cited

U.S. PATENT DOCUMENTS

| | | | | |
|---|---|---|---|---|
| 10,315,668 | B2 | 6/2019 | Early | |
| 2007/0084378 | A1* | 4/2007 | Creighton | B61D 7/28 105/247 |
| 2017/0267259 | A1* | 9/2017 | Ozerdim | E06B 7/22 |
| 2018/0222495 | A1* | 8/2018 | Huck | B61D 7/24 |
| 2018/0281824 | A1* | 10/2018 | Reitz | B61D 7/28 |
| 2018/0345997 | A1* | 12/2018 | Reitz | B61D 7/06 |
| 2018/0345998 | A1* | 12/2018 | Reitz | B61D 7/20 |
| 2019/0001997 | A1* | 1/2019 | Richmond | B61D 7/02 |
| 2019/0202481 | A1* | 7/2019 | Vande Sande | B61D 7/26 |

OTHER PUBLICATIONS

International Preliminary Report on Patentability for PCT Patent Application No. PCT/US2018/034186, dated Dec. 12, 2019; 7 pages.

* cited by examiner

HOPPER CAR DISCHARGE GATES

RELATED APPLICATION

This application claims priority to U.S. Provisional Application Ser. No. 62/514,486, entitled "HOPPER CAR DISCHARGE GATES," filed Jun. 2, 2017.

TECHNICAL FIELD

Particular embodiments relate generally to railcars, and more particularly to non-horizontal discharge gates for railcars, such as hopper cars for carrying bulk materials.

BACKGROUND

Railway hopper cars transport and sometimes store bulk materials. Hopper cars generally include one or more hoppers which may hold cargo or lading during shipment. Hopper cars are frequently used to transport coal, sand, metal ores, aggregates, grain and any other type of lading which may be satisfactorily discharged through openings formed in one or more hoppers. Discharge openings are typically provided at or near the bottom of each hopper to rapidly discharge cargo. A variety of door assemblies or gate assemblies along with various operating mechanisms have been used to open and close discharge openings associated with railway hopper cars.

Transversely oriented discharge openings and gates are frequently coupled with a common linkage operated by an air cylinder. The air cylinder is typically mounted in the same orientation as the operating gate linkage which is often a longitudinal direction relative to the associated hopper.

Longitudinally oriented discharge openings and doors are often used in pairs that may be rotated or pivoted relative to the center sill or side sills of a hopper car. Longitudinally oriented discharge openings and doors may be coupled with a beam operated by an air cylinder. The air cylinder is typically mounted in the same orientation as the operating beam which is often a longitudinal direction relative to the associated hopper. The operating beam may be coupled to the discharge doors by door struts that push (or pull) the gates open or pull (or push) them closed as the air cylinder moves the operating beam back and forth.

Hopper cars may be classified as open or closed. Hopper cars may have relatively short sidewalls and end walls or relatively tall or high sidewalls and end walls. The sidewalls and end walls of many hopper cars are often formed from steel or aluminum sheets and reinforced with a plurality of vertical side stakes or support posts. Some hopper cars include interior frame structures or braces to provide additional support for the sidewalls.

SUMMARY

Railcars that carry commodities that are discharged from the bottom of the railcar typically use a slide gate mechanism to open gates that permit the lading to flow out of the railcar using gravity. The gates may be opened manually or with the aid of externally applied mechanical tools. Conventionally, commodity is dropped from a horizontal sliding gate. For example, a railcar discharge gate mounting frame may be arranged along a horizontal plane and the slide gates operate in a horizontal direction along the longitudinal axis of the railcar (see FIGS. 1-3).

The slide gates are available in a limited number of sizes and are widely available to everyone in the industry. The outlet gates are standard components within the railroad industry. Common nominal sizes are 13×42, 30×30, and 42×42 inches. A typical hopper car may have two or three hoppers, with a gate for each hopper.

The in-plane orientation and the horizontal travel of the slides in the longitudinal direction dictate the overall length (OAL) of the railcar. The outlet gates are spaced at a particular distance apart to provide room for each gate to open without interfering with the adjacent hopper.

The column load on the discharge gate is a major factor in limiting the size of a discharge gate. In particular embodiments, rearranging the discharge gates with a vertical component reduces the column load on the discharge gate. Reduced column load facilitates a larger opening and opportunity to reconfigure the car for more capacity in a shorter distance.

With new gate sizing and geometry (e.g., vertical component to gate arrangement), the discharge gates may be disposed under the car closer together. In particular embodiments, the discharge gates may be opposite each other symmetrically about the longitudinal centerline of the car. Particular embodiments facilitate a larger commodity capacity in a shorter length.

Particular embodiments include an approximately twelve-inch tall by variable length discharge gate rotated approximately forty-five degrees from the horizontal and disposed proximate each side of the center sill on a through-sill covered hopper car. In particular embodiments, the discharge gate comprises a sliding panel. The drive mechanism for the discharge gate or gates may include rack and pinion, hydraulic, electric, or pneumatic drive systems.

In some embodiments, a railcar may include multiple discharge gates longitudinally along the center sill of a rail car. The discharge gates may open either longitudinally or transversely. The discharge gates on each side of the longitudinal centerline of the railcar may be aligned with each other longitudinally (i.e., directly across from each other), or may be offset from each other longitudinally. The particular placement of the discharge gates may direct the discharge flow of a commodity to meet a desired flow pattern.

According to some embodiments, a railcar comprises: an underframe comprising a center sill extending longitudinally along a centerline of the railcar; a hopper coupled to the underframe and comprising a first discharge opening; and a discharge assembly coupled to the hopper. The discharge assembly comprises a first sloped side sheet, and a first discharge gate frame in a plane offset from horizontal and extending from a bottom of the first sloped side sheet to proximate the center sill. The first discharge gate frame at least partially surrounds the first discharge opening. The discharge assembly further comprises a first discharge gate coupled to the first discharge gate frame. The first discharge gate is operable to move from a closed position that restricts a lading from discharging through the first discharge opening to an open position that permits the lading to discharge through the first discharge opening. Moving from the closed position to the open position comprises moving at an angle upward and transverse to the railcar towards the centerline of the railcar.

In particular embodiments, the first discharge gate frame is offset forty-five degrees from horizontal. The first discharge gate and the first discharge opening may be approximately the same length. The first discharge gate may be approximately twelve inches wide.

In particular embodiments, the hopper comprises a second discharge opening on an opposite side of the center sill from the first discharge opening. The discharge assembly further comprises a second sloped side sheet on an opposite side of the center sill from the first discharge opening, and a second discharge gate frame in a plane offset from horizontal and extending from a bottom of the second sloped side sheet to proximate the center sill. The second discharge gate frame at least partially surrounds the second discharge opening. The discharge assembly further comprises a second discharge gate coupled to the second discharge gate frame. The second discharge gate is operable to move from a closed position that restricts a lading from discharging through the second discharge opening to an open position that permits the lading to discharge through the second discharge opening. Moving from the closed position to the open position comprises moving at an angle upward and transverse to the railcar towards the centerline of the railcar.

In particular embodiments, the first discharge gate frame is positioned longitudinally adjacent the second discharge gate frame. The first discharge gate frame may be positioned longitudinally offset from the second discharge gate frame.

According to some embodiments, a railcar discharge assembly comprises a first sloped side sheet, and a first discharge gate frame in a plane offset from horizontal and, when coupled to a railcar, extends from a bottom of the first sloped side sheet upwards towards a center sill of the railcar. The first discharge gate frame at least partially surrounds a first discharge opening. The railcar discharge assembly further comprises a first discharge gate coupled to the first discharge gate frame. The first discharge gate is operable to move from a closed position that restricts a lading from discharging through the first discharge opening to an open position that permits the lading to discharge through the first discharge opening. Moving from the closed position to the open position comprises moving at an angle upward and transverse to the railcar towards the center sill of the railcar.

In particular embodiments, the first discharge gate frame is offset forty-five degrees from horizontal. The first discharge gate and the first discharge opening may be approximately the same length. The first discharge gate may be approximately twelve inches wide.

In particular embodiments, the railcar discharge assembly further comprises a second sloped side sheet on an opposite side of the center sill from the first discharge opening, and a second discharge gate frame in a plane offset from horizontal and, when coupled to a railcar, extends from a bottom of the second sloped side sheet upwards towards the center sill of the railcar. The second discharge gate frame at least partially surrounds a second discharge opening. The railcar discharge assembly further comprises a second discharge gate coupled to the second discharge gate frame. The second discharge gate is operable to move from a closed position that restricts the lading from discharging through the second discharge opening to an open position that permits the lading to discharge through the second discharge opening. Moving from the closed position to the open position comprises moving at an angle upward and transverse to the railcar towards the center sill of the railcar.

In particular embodiments, the first discharge gate frame is positioned longitudinally adjacent the second discharge gate frame. The first discharge gate frame may be positioned longitudinally offset from the second discharge gate frame.

According to some embodiments, railcar comprises: an underframe comprising a center sill extending longitudinally along a centerline of the railcar; a hopper coupled to the underframe and comprising a first discharge opening; and a discharge assembly coupled to the hopper. The discharge assembly comprises a first sloped side sheet, and a first discharge gate frame in a plane offset from horizontal and extending from a bottom of the first sloped side sheet at an angle upward and transverse to the railcar towards the center sill. The first discharge gate frame at least partially surrounds the first discharge opening. The discharge assembly further comprises a first set of one or more discharge gates coupled to the first discharge gate frame. The first set of one or more discharge gates is operable to move from a closed position that restricts a lading from discharging through the first discharge opening to an open position that permits the lading to discharge through the first discharge opening. Moving from the closed position to the open position comprises moving longitudinal to the railcar.

In particular embodiments, the first discharge gate frame is offset forty-five degrees from horizontal. The first discharge gate may be approximately twelve inches wide.

In particular embodiments, the hopper comprises a second discharge opening on an opposite side of the center sill from the first discharge opening. The discharge assembly further comprises a second sloped side sheet on an opposite side of the center sill from the first discharge opening, and a second discharge gate frame in a plane offset from horizontal and extending from a bottom of the second sloped side sheet at an angle upward and transverse to the railcar towards the center sill. The second discharge gate frame at least partially surrounds the second discharge opening. The discharge assembly further comprises a second set of one or more discharge gates coupled to the second discharge gate frame. The second set of one or more discharge gates is operable to move from a closed position that restricts a lading from discharging through the second discharge opening to an open position that permits the lading to discharge through the second discharge opening. Moving from the closed position to the open position comprises moving longitudinal to the railcar.

In particular embodiments, the first set of one or more discharge gates is positioned longitudinally adjacent the second set of one or more discharge gates. The first set of one or more discharge gates may be positioned longitudinally offset from the second set of one or more discharge gates.

Particular embodiments of the present disclosure may provide numerous technical advantages. For example, particular embodiments may provide reduced railcar length. Reduced railcar length enables a unit train consist to accommodate more railcars in a given linear track, which increases overall rail system efficiency. Reduced railcar length also facilitates more railcars to be spotted in a siding or in a shipper's facility. These factors may reduce the number of locomotives, crew, and overhead needed to move a given amount of commodity.

In addition, the reduced length may reduce the tare weight of each railcar unit. A reduced tare weight facilitates carrying more lading per railcar and may reduce the construction cost of each unit.

Particular embodiments may provide improved control over the direction of the discharge flow of the railcar commodity. Particular embodiments of the present disclosure may provide some, none, all, or additional technical advantages.

BRIEF DESCRIPTION OF THE DRAWINGS

For a more complete understanding of the particular embodiments, and the advantages thereof, reference is now made to the following written description taken in conjunction with the accompanying drawings, in which.

DETAILED DESCRIPTION

Railway hopper cars generally include one or more hoppers which may hold cargo or lading (e.g., bulk materials) during shipment. Hopper cars frequently transport coal, sand, metal ores, aggregates, grain, plastic pellets, and any other type of lading which may be satisfactorily discharged through openings formed in one or more hoppers. Discharge openings are typically provided at or near the bottom of each hopper to rapidly discharge cargo. A variety of door assemblies or gate assemblies along with various operating mechanisms have been used to open and close discharge openings associated with railway hopper cars.

Figure 1:
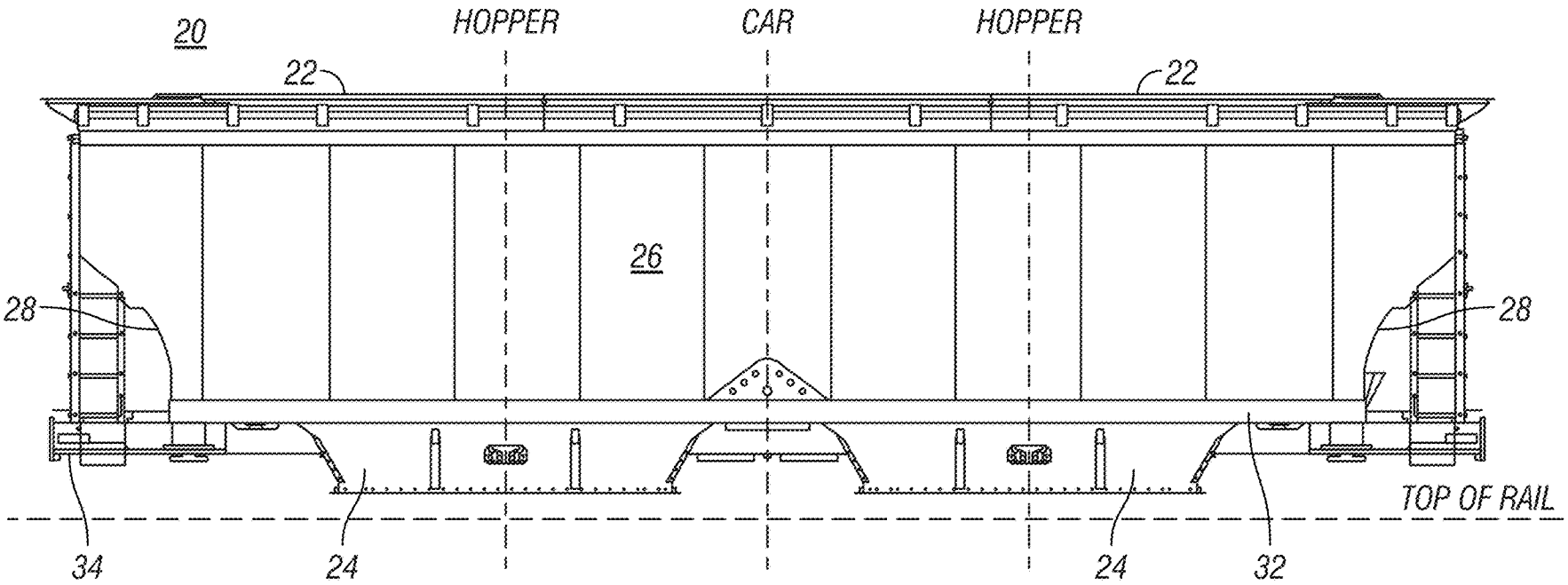
FIG. 1 is a schematic drawing showing a side view of an example hopper car.

FIG. 1 is a schematic drawing illustrating a side view of an example hopper car. Hopper car 20 may carry bulk materials such as coal and other types of lading. Examples of such lading may include sand, metal ores, aggregate, grain, ballast, etc.

Hopper car 20 may be generally described as a covered hopper car. However, other embodiments may include open hopper cars or any other cars (e.g., gondola cars) suitable for carrying bulk lading. Hopper car 20 includes containers for transporting its lading, such as hoppers 22 with bottom discharge assemblies 24. Discharge assemblies 24 may be opened and closed to control discharge of lading from hoppers 22. As illustrated, hopper car 20 includes two hoppers 22. Particular embodiments of hopper car 20 may include one, two, three, or any suitable number of hoppers 22. Particular embodiments may include other containers for transporting lading, with or without discharge assemblies.

In particular embodiments, hopper 22 is configured to carry bulk materials and the interior walls of hopper 22 are generally sloped towards discharge assembly 24 to facilitate discharge of the lading. Multiple hoppers 22 may be separated by interior bulkheads.

In particular embodiments, hopper car 20 may include a pair of sidewall assemblies 26 and sloped end wall assemblies 28 mounted on a railway car underframe. The railway car underframe includes center sill 34 and a pair of sill plates 32. The pair of sill plates 32 provide support for sidewall assemblies 26.

Center sill 34 extends along a longitudinal centerline of hopper car 20 and is a structural element for carrying the loads of the hopper car. Center sill 34 transfers the various longitudinal forces encountered during train operation from car to car.

Conventional hopper cars may typically have 2, 3 or 4 hoppers with a single sliding gate below the discharge opening of each hopper. The sloping interior walls of hopper 22 create a ridge between the discharge openings to guide the lading towards the discharge opening. The sloping walls may also be referred to as gate supports. Conventional hopper cars typically have tall ridges between hoppers 22. An example of a ridge is illustrated in FIG. 2.

Figure 2:
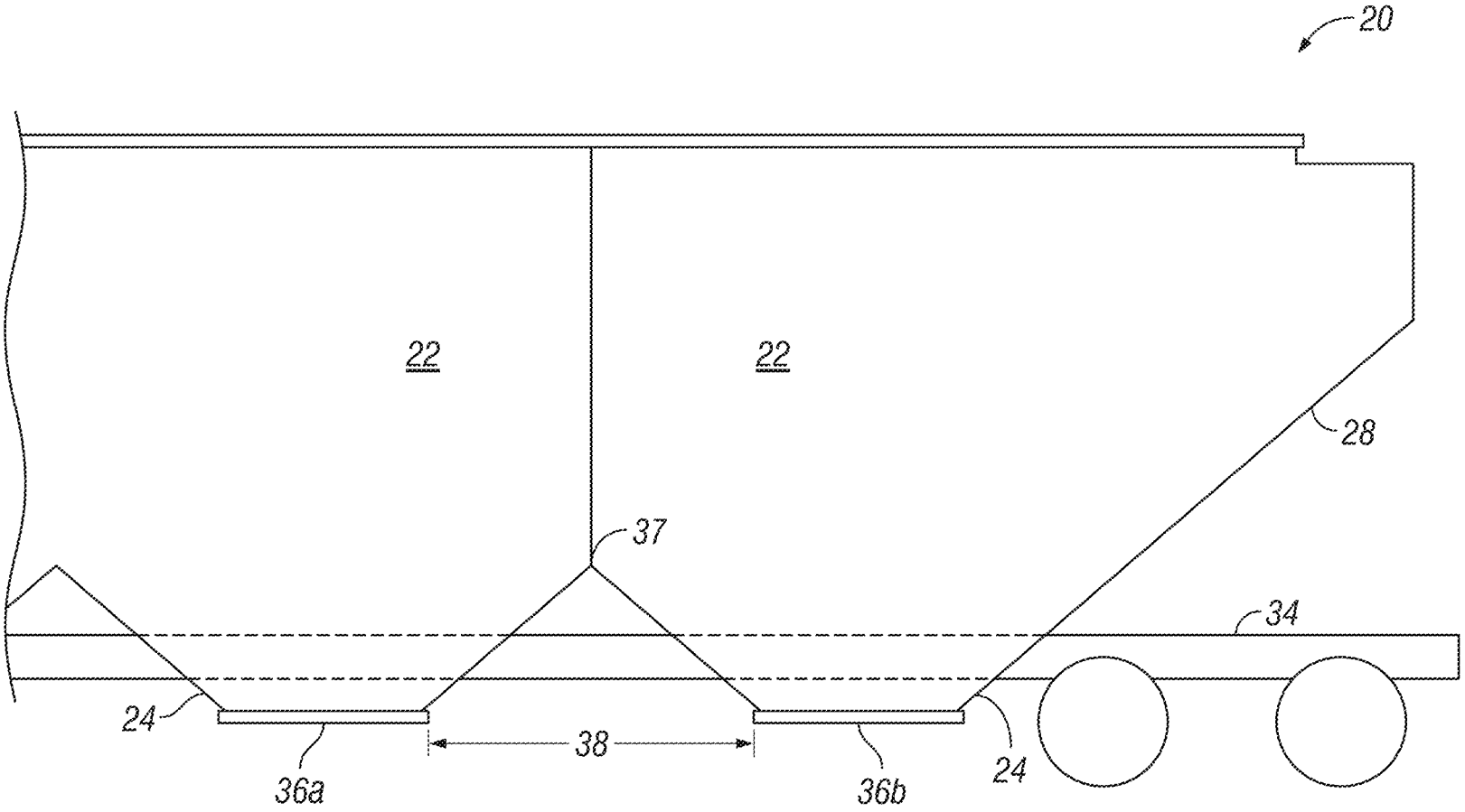
FIG. 2 is a schematic drawing illustrating a side view of the ridges and center sill of an example hopper car.

FIG. 2 is a schematic drawing illustrating a side view of the ridges and center sill of an example hopper car. Hopper car 20 is similar to hopper car 20 described with respect to FIG. 1. Hopper car 20 includes two hoppers 22 with discharge assemblies 24. Transverse discharge gates 36 are operable to slide in the longitudinal direction of hopper car 20 to discharge the lading of hoppers 22 through the discharge openings of discharge assemblies 24.

The sloping interior walls of hopper 22 form ridge 37. Ridge 37 comprises two sloping edges between adjacent discharge gates 36*a* and 36*b*. Distance 38 is the distance between adjacent discharge gates 36*a* and 36*b*. Ridge 37 is widest at its bottom-most portion (i.e., distance 38). The two sloping edges extend upward where they join together, forming ridge 37.

The particular width of discharge gates 36, and the particular width and height of ridges 37 depend on the length and height of hopper car 20 and each hopper 22. In some conventional hopper cars, gates 36 may be four or five feet wide and ridges 37 may be four feet high, as one example.

Gates 36 are arranged in a horizontal plane and they slide horizontally along the longitudinal axis of hopper car 20. Distance 38 must be large enough that gate 36*a* does not interfere with discharge from an adjacent hopper when the gates are opened. Thus, distance 38 must at least be greater than the width of gate 36.

Figure 3:
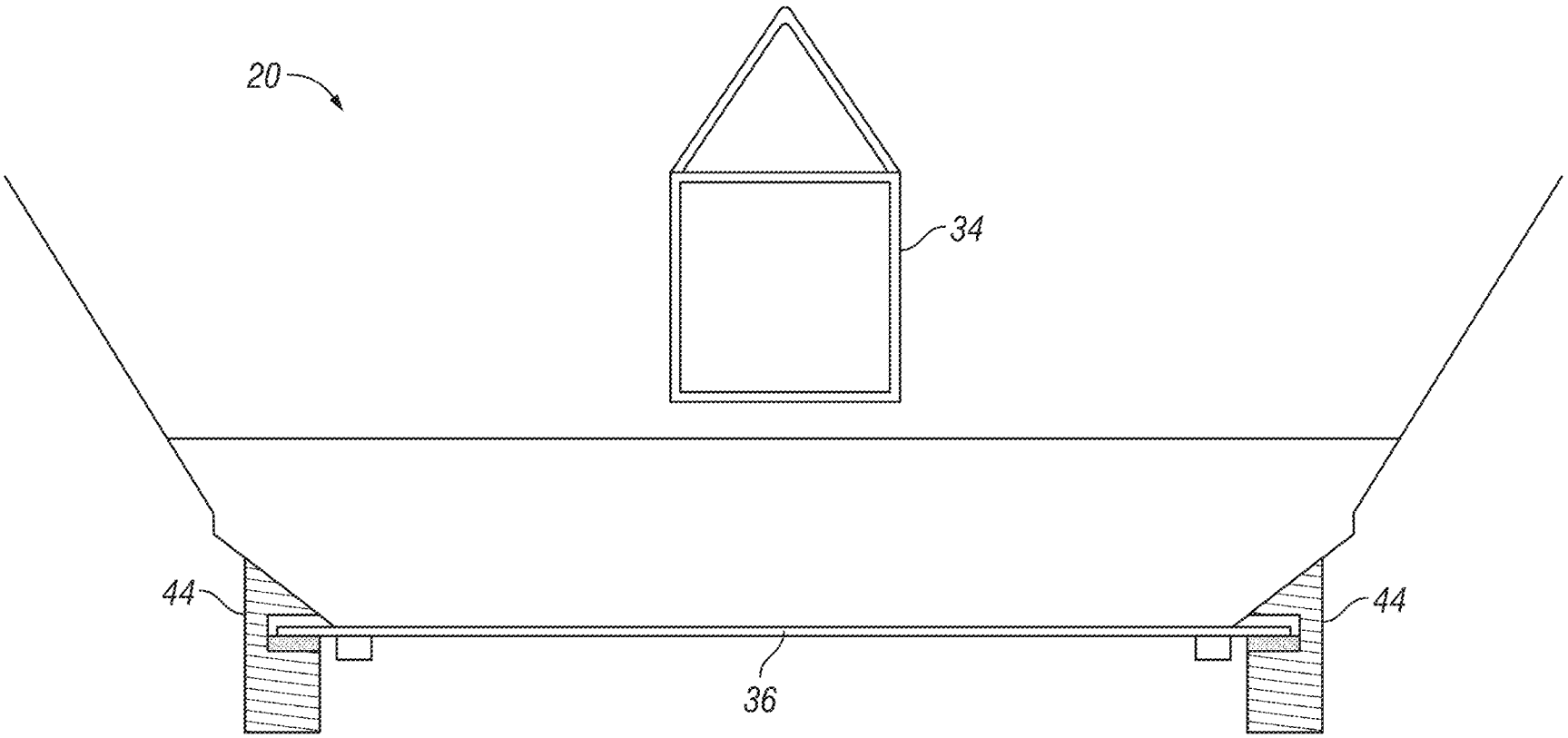
FIG. 3 is a schematic drawing illustrating a cross-sectional end view of a portion of a horizontal discharge gate.
Figure 5:
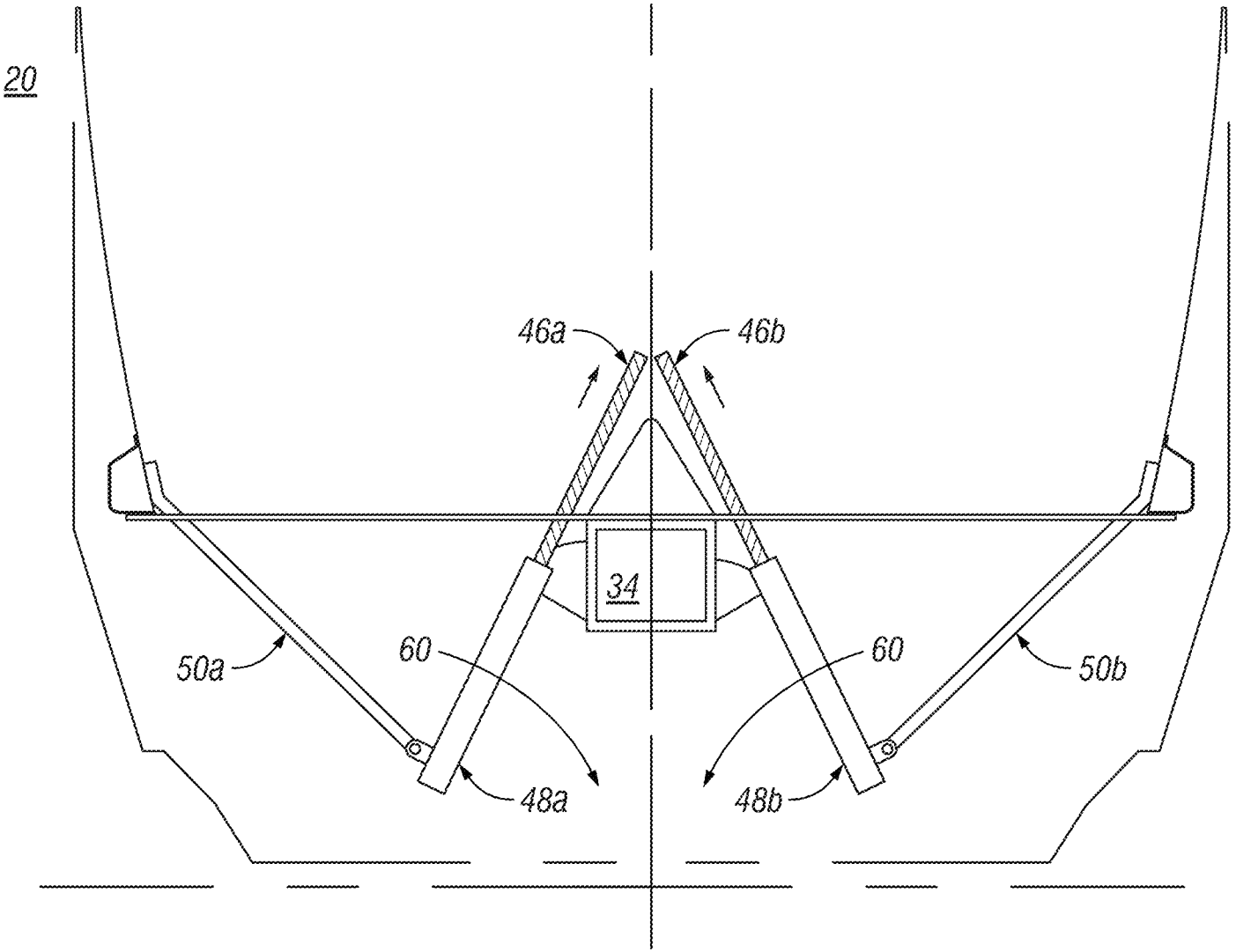
FIG. 5 is cross-section view of a hopper car with horizontally offset, vertically sliding discharge gates in the open position, according to a particular embodiment.

FIG. 3 is a schematic drawing illustrating a cross-sectional end view of a portion of a horizontal discharge gate. FIG. 5 illustrates a cross sectional view of hopper car 20 described with respect to FIGS. 1 and 2.

Support frame 44 may comprise a pair of support members coupled to the sidewalls of hopper car 20. Support frame 44 is coupled to hopper car 20 proximate the discharge openings. Support frame 44 supports discharge gate 36, which extends transversely across the width of hopper car 20.

Discharge gate 36 is supported by a groove in support member 44. Discharge gate 36 may be supported by a ledge or any other suitable support. Discharge gate 36 may slide on a low-friction material. Discharge gate 36 may be referred to as slidably coupled to support frame 44.

Brackets may couple adjacent discharge gates 36. In the illustrated embodiment, brackets are coupled to discharge gates 36 just outside of support frame 44 towards the center of railcar 30. In other embodiments, the brackets may be disposed within support frame 44 in a groove or other suitable opening.

The discharge gates and gate frames are available in a limited number of sizes and are widely available to everyone in the industry. The outlet gates are standard components within the railroad industry. Common nominal sizes are 13×42, 30×30, and 42×42 inches. A typical hopper car may have two or three hoppers, with a gate for each hopper.

The in-plane orientation and the horizontal travel of the slide gates in the longitudinal direction dictate the overall length (OAL) of the railcar. The discharge gates are spaced at a particular distance apart to provide room for each gate to open without interfering with the adjacent hopper.

The column load on the discharge gate is a major factor in limiting the size of a discharge gate. In particular embodiments, rearranging the discharge gates with a vertical component reduces the column load on the discharge gate. Reduced column load facilitates a larger opening and opportunity to reconfigure the car for more capacity in a shorter distance.

With new gate sizing and geometry (e.g., vertical component to gate arrangement), the discharge gates may be disposed under the car closer together. In particular embodiments, the discharge gates may be opposite each other symmetrically about the longitudinal centerline of the car. Particular embodiments facilitate a larger commodity capacity in a shorter length.

Particular embodiments include an approximately twelve-inch tall by variable length discharge gate rotated approximately forty-five degrees from the horizontal and disposed proximate each side of the center sill on a through-sill covered hopper car. An example is illustrated in FIG. 4.

Figure 4:
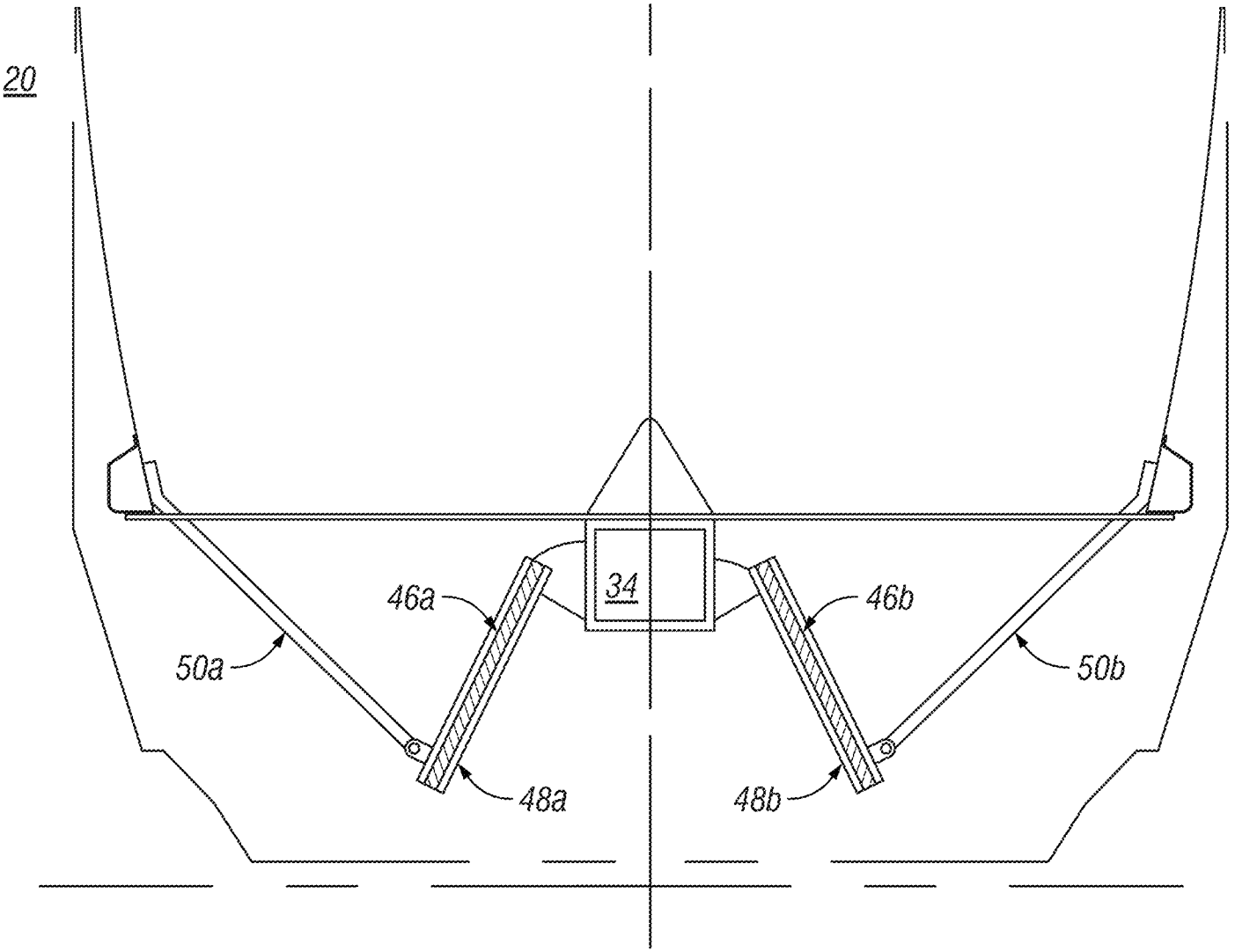
FIG. 4 is cross-section view of a hopper car with horizontally offset, vertically sliding discharge gates in the closed position, according to a particular embodiment.

FIG. 4 is cross-section view of a hopper car with horizontally offset, vertically sliding discharge gates in the closed position, according to a particular embodiment. Hopper car 20 is similar to hopper car 20 described with respect to FIGS. 1-3, except that discharge gates 46 are non-horizontal (as compared to horizontal discharge gates 36 of FIG. 2).

Hopper car 20 includes fixed discharge gate frame 48 that extends transversely at an upward angle from sloped side sheet 50 of hopper car 20 to center sill 34. Fixed discharge gate frame 48 frames a discharge opening in the hopper. For example, fixed discharge gate frame 48 may comprise tracks or grooves proximate the edges of the discharge opening, similar to support frame 44 illustrated in FIG. 3.

Fixed discharge gate frame 48 houses discharge gate 46. Discharge gate 46 comprises a sliding panel. Discharge gate 46 is slidably coupled to fixed discharge gate frame 48. In the closed position, as illustrated, discharge gate 46 prevents the lading of hopper car 20 from exiting the discharge opening that is framed by fixed discharge gate frame 48.

Fixed discharge gate frame 48*a* is disposed across the longitudinal centerline of hopper car 20 from fixed discharge gate frame 48*b*. Fixed discharge gate frame 48*a* may be referred to as aligned longitudinally with fixed discharge gate frame 48*b*.

Because fixed discharge gate frame 48 and discharge gate 46 extend transversely at an upward angle from the sloped side sheet of hopper car 20 to center sill 34, the column weight on fixed discharge gate frame 48 and discharge gate 46 may be less than the column weight on a horizontal discharge gate, such as support frame 44 and discharge gate 36 in FIG. 2, for example. A particular advantage of reduced column weight is that discharge gate 46 may be larger than a horizontal discharge gate, providing faster discharge and/or increased railcar volume or decreased railcar overall length.

In particular embodiments discharge gate 46 may be approximately twelve inches in width. The length of discharge gate 46 in the longitudinal direction may vary based on factors such as lading type, railcar length, number of discharge gates, etc.

Discharge gates 46 are slidably coupled to fixed discharge gate frames 48. Discharge gates 46 are configured to slide on fixed discharge gate frames 48 to create a discharge opening to discharge the lading of hopper car 20. An example of discharge gates 46 in the open position is illustrated in FIG. 5.

FIG. 5 is cross-section view of a hopper car with horizontally offset, vertically sliding discharge gates in the open position, according to a particular embodiment. Discharge gate 46 slides inward and upward to open the discharge opening framed by fixed discharge gate frame 48, thus discharging the lading of hopper car 20. Arrows 60 represent the lading discharging through the discharge opening. The dashed portion of arrows 60 indicates that the lading passes through the discharge opening between fixed discharge gate frame 48 (i.e., the sectional view only illustrates one edge of fixed discharge gate frame 48, the lading passes through the discharge opening behind the illustrated edge of fixed discharge gate frame 48).

Although discharge gate 46 is described as a sliding panel and described as slidably coupled to fixed discharge gate frame 48, "sliding" or "slidably" as used herein refers to the back and forth motion of discharge gate 46 within or on portions of discharge gate frame 48 and is meant to include any suitable action (e.g., sliding, rolling, pushing, pulling, etc.). For example, in some embodiments portions of discharge gate 46 and/or discharge frame 48 may comprise gears for moving discharge gate 46.

In particular embodiments, discharge gate 46 may be operated by rack and pinion, hydraulic, electric, or pneumatic drive systems. Other embodiments may use any suitable drive system. A single drive system may operate both discharge gates 46*a* and 46*b*. A drive system may operate discharge gates 46*a* and 46*b* simultaneously, or independently.

The number and placement of the discharge gates may vary depending on factors such as lading type, railcar length, etc. For example, the discharge gates on each side of the longitudinal centerline of the railcar may be aligned with each other longitudinally (i.e., directly across from each other as illustrated), or may be offset from each other longitudinally (e.g., staggered longitudinally). The particular placement of the discharge gates may direct the discharge flow of a commodity to meet a desired flow pattern.

Although discharge gates 46 are illustrated as extending into the hopper of hopper car 20 when in the open position, in other embodiments discharge gates 46 may be separated from or protected from the lading of hopper car 20 by a portion of fixed discharge gate frame 48, or some other suitable covering or support, when in the open position. For example, fixed discharge gate frame 48 may be wider than illustrated in FIGS. 4 and 5. If the illustrated examples include a 12 inch wide discharge gate 46 and a 12 inch wide discharge gate frame 48, other embodiments may include a 12 inch wide discharge gate 46 and at 24 inch or wider discharge gate frame 48, such that discharge gate 46 is still within discharge gate frame 48 even in the open position. Portions of the discharge gate frame 48 not adjacent the discharge opening may comprise a pocket or shield to prevent discharge gate 46 from contacting the lading when in the open position.

In the previous examples, discharge gate frame 48 is offset from horizontal and discharge gate 46 slides at an angle vertically and transversely to the railcar. In some embodiments, fixed discharge gate frame 48 is offset from horizontal and discharge gate 46 may operate by sliding in the longitudinal direction. An example is illustrated in FIG. 6.

Figure 6:
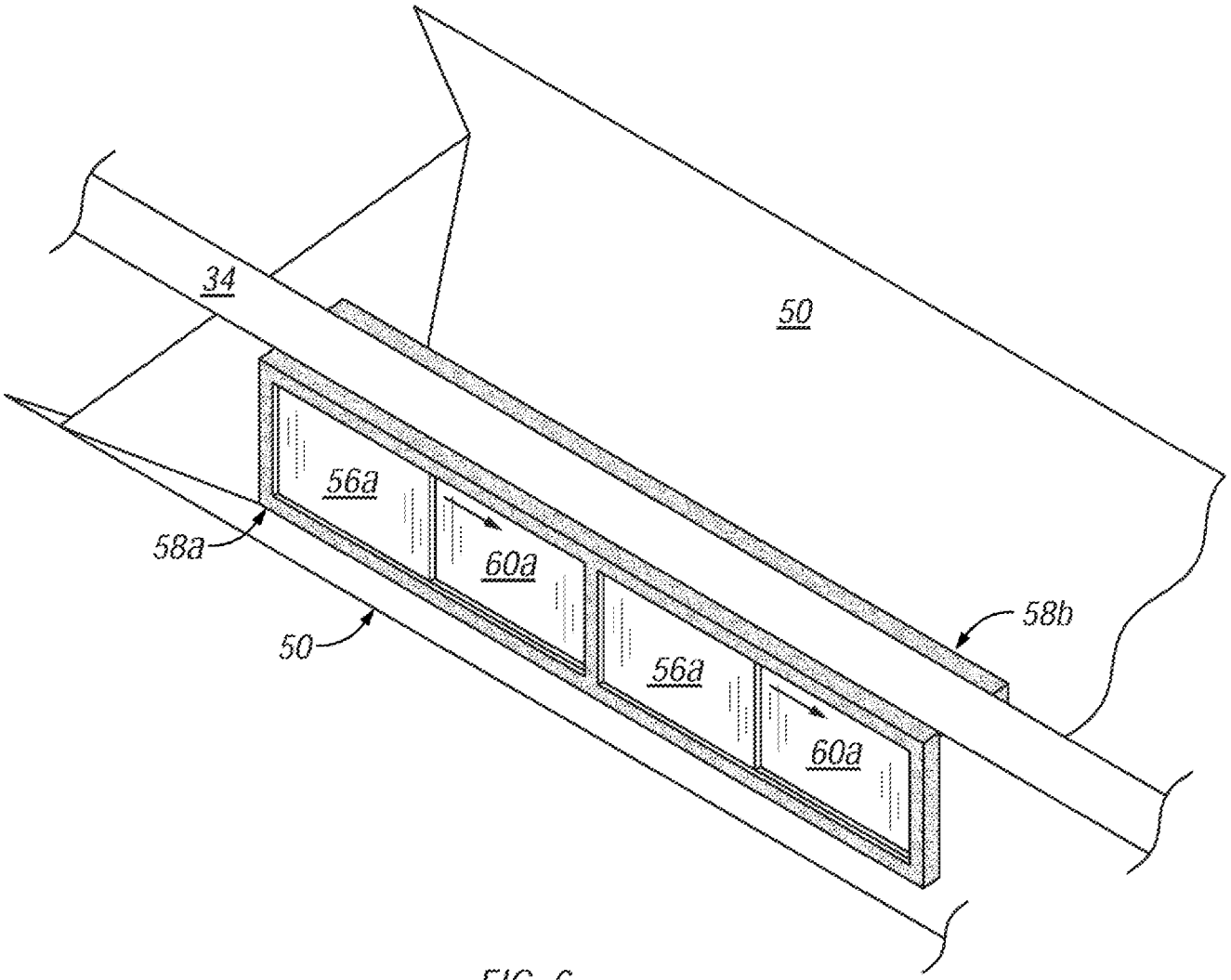
FIG. 6 is a perspective schematic of the hopper portion of a hopper car with horizontally offset, longitudinally sliding discharge gates in a closed position, according to a particular embodiment.

FIG. 6 is a perspective schematic of the hopper portion of a hopper car with horizontally offset, longitudinally sliding discharge gates in a closed position, according to a particular embodiment. Fixed discharge gate frame 58 extends transversely at an upward angle from sloped side sheet 50 of hopper car 20 to center sill 34. Fixed discharge gate frame 58 may include one or more discharge openings (see FIG. 7) and one or more fixed panels 60.

Fixed discharge gate frame 58*a* is disposed across the longitudinal centerline of hopper car 20 from fixed discharge gate frame 58*b*. Fixed discharge gate frame 58*a* may be referred to as aligned longitudinally with fixed discharge gate frame 58*b*.

Fixed discharge gate frame 58 houses discharge gate 56. Discharge gate 56 comprises a sliding panel. In the closed position, as illustrated, discharge gate 56 covers a discharge opening in fixed discharge gate frame 58 and prevents the lading of hopper car 20 from exiting the discharge openings surrounded by fixed discharge gate frame 58. In particular embodiments, fixed discharge gate frame 58 may include multiple discharge gates 56. The illustrated example includes two discharge gates 56. Also, fixed discharge gate frame 58 is illustrated with a center cross support. Other embodiments may include fewer (e.g., none) or more cross supports depending, for example, on the length of fixed discharge gate frame 58.

Discharge gates 56 are slidably coupled to fixed discharge gate frames 58. Discharge gates 56 are configured to slide on fixed discharge gate frames 58 to create a discharge opening (see FIG. 7). In operation, discharge gates 56 slide longitudinally (illustrated arrows) to discharge the lading of hopper car 20.

Figure 7:
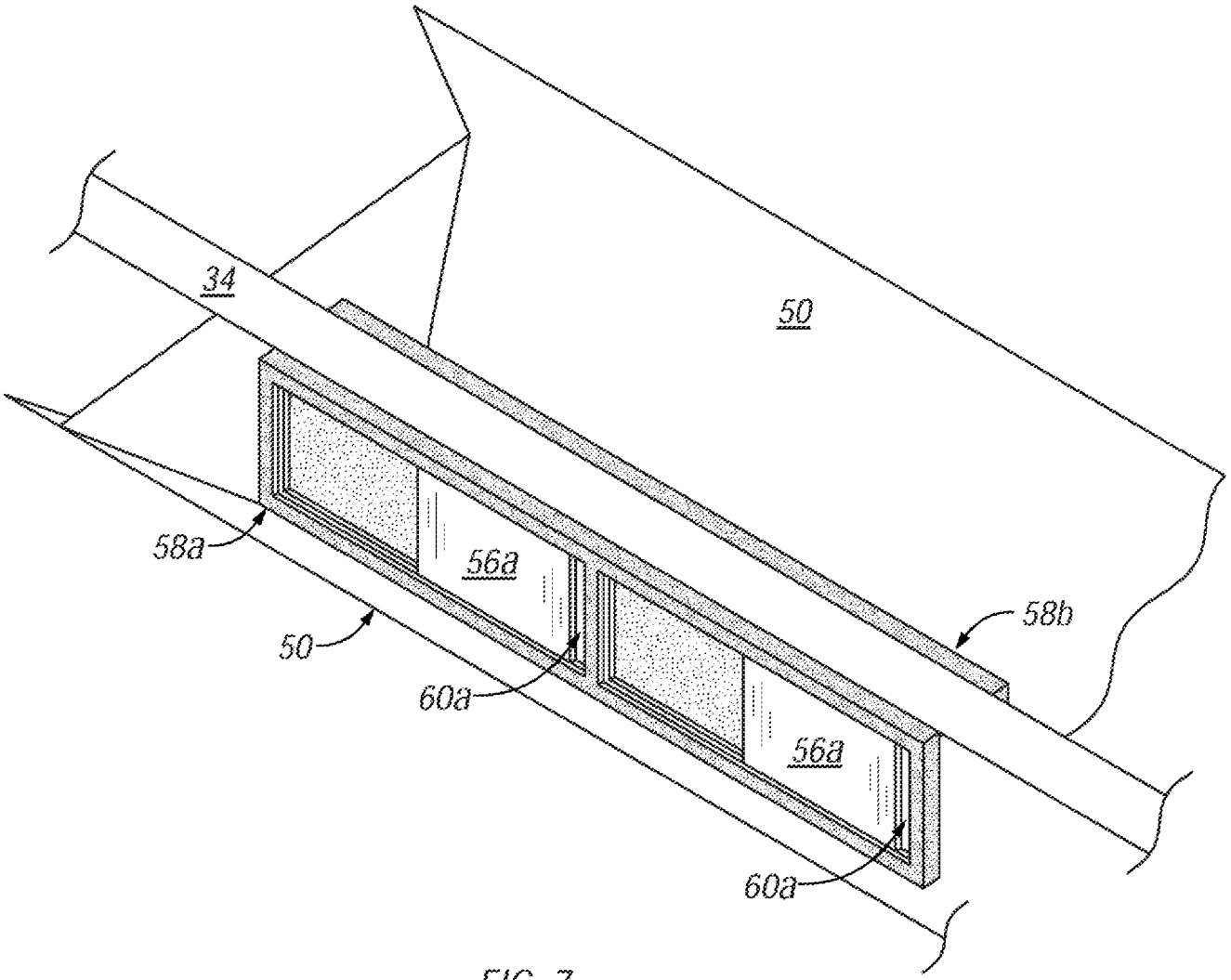
FIG. 7 is a perspective schematic of the hopper portion of a hopper car with horizontally offset, longitudinally sliding discharge gates in an open position, according to a particular embodiment.

FIG. 7 is a perspective schematic of the hopper portion of a hopper car with horizontally offset, longitudinally sliding discharge gates in an open position, according to a particular embodiment. In the illustrated example, discharge gates 56 are in the open position which facilitates lading to discharge through the discharge opening.

Similar to the examples in FIGS. 4 and 5, because fixed discharge gate frame 58 and discharge gate 56 extend transversely at an upward angle from the sloped side sheet of hopper car 20 to center sill 34, the column weight on fixed discharge gate frame 58 and discharge gate 56 may be less than the column weight on a horizontal discharge gate. A particular advantage of reduced column weight is that discharge gate 56 may be larger than a horizontal discharge gate, providing faster discharge and/or increased railcar volume or decreased railcar overall length.

In particular embodiments, discharge gate 56 may be operated by rack and pinion, hydraulic, electric, or pneumatic drive systems. Other embodiments may use any suitable drive system. A single drive system may operate both discharge gates 56*a* and 56*b* (not illustrated). A drive system may operate discharge gates 56*a* and 56*b* simultaneously, or independently.

Although two discharge gates 56 are illustrated on each side of the railcar, in particular embodiments the number and placement of the discharge gates may vary depending on factors such as lading type, railcar length, etc. For example, the discharge gates on each side of the longitudinal centerline of the railcar may be aligned with each other longitudinally (i.e., directly across from each other as illustrated), or may be offset from each other longitudinally (e.g., staggered longitudinally). The particular placement of the discharge gates may direct the discharge flow of a commodity to meet a desired flow pattern.

Particular embodiments of the present disclosure may provide numerous technical advantages. For example, particular embodiments may provide reduced railcar length. Reduced railcar length enables the unit train consist to accommodate more railcars in a given linear track, which increases overall rail system efficiency. Reduced railcar length also facilitates more railcars to be spotted in a siding or in a shipper's facility. These factors may reduce the number of locomotives, crew, and overhead needed to move a given amount of commodity.

In addition, the reduced length may reduce the tare weight of each railcar unit. A reduced tare weight facilitates carrying more lading per railcar and may reduce the construction cost of each unit.

Particular embodiments may provide improved control over the direction of the discharge flow of the railcar commodity. Particular embodiments of the present disclosure may provide some, none, all, or additional technical advantages.

Although the components in FIGS. 1-7 are described with respect to a particular hopper car with a particular number of hoppers, particular embodiments may include any suitable type of railcar with any suitable number of discharge gates.

Although particular embodiments and their advantages have been described in detail, it should be understood that various changes, substitutions and alternations can be made herein without departing from the spirit and scope of the embodiments.

The invention claimed is:

1. A railcar comprising:

an underframe comprising a center sill extending longitudinally along a centerline of the railcar;

a hopper coupled to the underframe, the hopper comprising a first discharge opening;

a discharge assembly coupled to the hopper, the discharge assembly comprising:

a first sloped side sheet;

a first discharge gate frame in a plane offset from horizontal and extending from a bottom of the first sloped side sheet to proximate the center sill, the first discharge gate frame at least partially surrounding the first discharge opening; and a first discharge gate coupled to the first discharge gate frame, the first discharge gate operable to move from a closed position that restricts a lading from discharging through the first discharge opening to an open position that permits the lading to discharge through the first discharge opening, wherein moving from the closed position to the open position comprises moving at an angle upward and transverse to the railcar towards the centerline of the railcar.

2. The railcar of claim 1, wherein the first discharge gate frame is offset forty-five degrees from horizontal.

3. The railcar of claim 1, wherein the first discharge gate and the first discharge opening are approximately the same length.

4. The railcar of claim 1, wherein the first discharge gate is approximately twelve inches wide.

5. The railcar of claim 1, wherein the hopper comprises a second discharge opening on an opposite side of the center sill from the first discharge opening, and the discharge assembly further comprises:

a second sloped side sheet on an opposite side of the center sill from the first discharge opening;

a second discharge gate frame in a plane offset from horizontal and extending from a bottom of the second sloped side sheet to proximate the center sill, the second discharge gate frame at least partially surrounding the second discharge opening; and a second discharge gate coupled to the second discharge gate frame, the second discharge gate operable to move from a closed position that restricts a lading from discharging through the second discharge opening to an open position that permits the lading to discharge through the second discharge opening, wherein moving from the closed position to the open position comprises moving at an angle upward and transverse to the railcar towards the centerline of the railcar.

6. The railcar of claim 5, wherein the first discharge gate frame is positioned longitudinally adjacent the second discharge gate frame.

7. The railcar of claim 5, wherein the first discharge gate frame is positioned longitudinally offset from the second discharge gate frame.

8. A railcar discharge assembly comprising:

a first sloped side sheet;

a first discharge gate frame in a plane offset from horizontal and, when coupled to a railcar, extending from a bottom of the first sloped side sheet upwards towards a center sill of the railcar, the first discharge gate frame at least partially surrounding a first discharge opening;

a first discharge gate coupled to the first discharge gate frame, the first discharge gate operable to move from a closed position that restricts a lading from discharging through the first discharge opening to an open position that permits the lading to discharge through the first discharge opening, wherein moving from the closed position to the open position comprises moving at an angle upward and transverse to the railcar towards the center sill of the railcar;

a second sloped side sheet on an opposite side of the center sill from the first discharge opening;

a second discharge gate frame in a plane offset from horizontal and, when coupled to a railcar, extending from a bottom of the second sloped side sheet upwards towards the center sill of the railcar, the second discharge gate frame at least partially surrounding a second discharge opening; and a second discharge gate coupled to the second discharge gate frame, the second discharge gate operable to move from a closed position that restricts the lading from discharging through the second discharge opening to an open position that permits the lading to discharge through the second discharge opening, wherein moving from the closed position to the open position comprises moving at an angle upward and transverse to the railcar towards the center sill of the railcar; and wherein the first discharge gate frame is positioned longitudinally adjacent the second discharge gate frame.

9. A railcar discharge assembly comprising:

a first sloped side sheet;

a first discharge gate frame in a plane offset from horizontal and, when coupled to a railcar, extending from a bottom of the first sloped side sheet upwards towards a center sill of the railcar, the first discharge gate frame at least partially surrounding a first discharge opening;

a first discharge gate coupled to the first discharge gate frame, the first discharge gate operable to move from a closed position that restricts a lading from discharging through the first discharge opening to an open position that permits the lading to discharge through the first discharge opening, wherein moving from the closed position to the open position comprises moving at an angle upward and transverse to the railcar towards the center sill of the railcar;

a second sloped side sheet on an opposite side of the center sill from the first discharge opening;

a second discharge gate frame in a plane offset from horizontal and, when coupled to a railcar, extending from a bottom of the second sloped side sheet upwards towards the center sill of the railcar, the second discharge gate frame at least partially surrounding a second discharge opening; and a second discharge gate coupled to the second discharge gate frame, the second discharge gate operable to move from a closed position that restricts the lading from discharging through the second discharge opening to an open position that permits the lading to discharge through the second discharge opening, wherein moving from the closed position to the open position comprises moving at an angle upward and transverse to the railcar towards the center sill of the railcar; and wherein the first discharge gate frame is positioned longitudinally offset from the second discharge gate frame.

10. A railcar comprising:

an underframe comprising a center sill extending longitudinally along a centerline of the railcar;

a hopper coupled to the underframe, the hopper comprising a first discharge opening;

a discharge assembly coupled to the hopper, the discharge assembly comprising:

a first sloped side sheet;

a first discharge gate frame in a plane offset from horizontal and extending from a bottom of the first sloped side sheet at an angle upward and transverse to the railcar towards the center sill, the first discharge gate frame at least partially surrounding the first discharge opening; and a first set of one or more discharge gates coupled to the first discharge gate frame, the first set of one or more discharge gates operable to move from a closed position that restricts a lading from discharging through the first discharge opening to an open position that permits the lading to discharge through the first discharge opening, wherein moving from the closed position to the open position comprises moving longitudinal to the railcar.

11. The railcar of claim 10, wherein the first discharge gate frame is offset forty-five degrees from horizontal.

12. The railcar of claim 10, wherein the first discharge gate is approximately twelve inches wide.

13. The railcar of claim 10, wherein the hopper comprises a second discharge opening on an opposite side of the center sill from the first discharge opening, and the discharge assembly further comprises:

a second sloped side sheet on an opposite side of the center sill from the first discharge opening;

a second discharge gate frame in a plane offset from horizontal and extending from a bottom of the second sloped side sheet at an angle upward and transverse to the railcar towards the center sill, the second discharge gate frame at least partially surrounding the second discharge opening; and a second set of one or more discharge gates coupled to the second discharge gate frame, the second set of one or more discharge gates operable to move from a closed position that restricts a lading from discharging through the second discharge opening to an open position that permits the lading to discharge through the second discharge opening, wherein moving from the closed position to the open position comprises moving longitudinal to the railcar.

14. The railcar of claim 13, wherein the first set of one or more discharge gates is positioned longitudinally adjacent the second set of one or more discharge gates.

15. The railcar of claim 13, wherein the first set of one or more discharge gates is positioned longitudinally offset from the second set of one or more discharge gates.

* * * * *